US007315004B1

(12) United States Patent
Jarzynka et al.

(10) Patent No.: US 7,315,004 B1
(45) Date of Patent: Jan. 1, 2008

(54) MOTION-ACTIVATED ELECTRICAL SWITCH

(75) Inventors: Peter W. Jarzynka, Pittsburgh, PA (US); H. Gene Baumgarten, Pittsburgh, PA (US)

(73) Assignee: Dawar Technologies, Pittsburgh, PA (US)

( * ) Notice: Subject to any disclaimer, the term of this patent is extended or adjusted under 35 U.S.C. 154(b) by 57 days.

(21) Appl. No.: 11/466,938

(22) Filed: Aug. 24, 2006

(51) Int. Cl.
*H01H 35/14* (2006.01)

(52) U.S. Cl. ..... 200/61.45 R; 200/61.51; 200/61.52

(58) Field of Classification Search ..... 200/61.45 R–61.53; 73/493, 504.12, 504.13, 514.01, 73/514.16, 514.35
See application file for complete search history.

(56) References Cited

U.S. PATENT DOCUMENTS 6,706,978 B2 * 3/2004 Wagatsuma et al. .. 200/61.45 R
6,852,935 B2 * 2/2005 Higgins et al. ..... 200/61.52
7,045,725 B2 * 5/2006 Gallagher et al. ..... 200/61.52

* cited by examiner

*Primary Examiner*—Michael Friedhofer
(74) *Attorney, Agent, or Firm*—Arnold B. Silverman; Eckert Seamans Cherin & Mellott, LLC

(57) ABSTRACT

A motion-activated electrical switch has a pair of spaced electrical circuits, each disposed on a support, and an electrical conductor interposed between spaced from and electrically insulated from the electrical circuits. An electrically conductive movable element is structured to assume a first position in contact with the electrical conductor and one of the electrical circuits and a second position out of contact with the electrical circuit is provided along with a power supply for energizing the switch. In one embodiment, the electrical conductor is a closed shape having an opening defined therethrough. A pair of conductive strips may be connected to the electrical conductor and to one of the electrical circuits such that movement of the electrically conducted movable element may serve to complete the circuit or to break the circuit.

29 Claims, 4 Drawing Sheets

MOTION-ACTIVATED ELECTRICAL SWITCH

BACKGROUND OF THE INVENTION

1. Field of the Invention

The present invention relates to a motion-activated electrical switch and, specifically, one which does not require the use of a flowable, electrically conductive material, such as mercury.

2. Description of the Prior Art

It has been known for many years to employ various types of electrical switches which are structured to move between an "off" position wherein the electrical circuit is not complete and one or more "on" positions wherein the electrical circuit is complete, thereby permitting electrical energy to energize whatever article or appliance is to receive the electrical energy, when desired.

Among the known electrical switches are mechanical switches, which move a conductive element into and out of physical contact with other switch components to achieve switch open and switch closed positions.

It has also been known to employ mercury in switches wherein in one position the mercury is located in an "off" position as a result of the lack of continuous electrical contact. In another position generally achieved by tilting the switch so as to cause the mercury to flow to a different position wherein the electrical circuit is complete, the switch is in the "on" position. One of the major problems with mercury is that it has been recognized as a hazardous material. For example, the European Union Directive 2002/95/EC entitled "Restriction of Hazardous Substances (RoHS)" restricts the use of certain hazardous substances in electrical and electronic equipment sold or used in the European Union after Jul. 1, 2006. Mercury is among the materials listed within this category.

There remains, therefore, a very real and substantial need for an improved electrical switch which is activated by motion and avoids the use of hazardous materials.

SUMMARY OF THE INVENTION

The present invention has met the hereinbefore described need. The present invention does provide a motion-activated electrical switch which has a pair of spaced electrical circuits disposed on supports and an electrical conductor interposed between an electrically insulated portion from the spaced electrical circuits. An electrically conductive movable element is structured to assume a first position in contact with said electrical conductor and a said electrical circuit and a second position out of contact with said electrical conductor. An internal power supply may be provided for energizing the switch. Otherwise, power is provided from an external source.

Movement of the movable conductor serves to establish a switch open or switch closed position.

The electrical conductor has an opening within which the electrically conductive movable element, which may be in the form of a rollable element, is positioned.

The switch assembly may be mounted on a base which is securable to an electrical appliance or lamp or other item to be energized.

It is an object of the present invention to provide an efficient, economical, motion-activated electrical switch which will function regardless of switch orientation.

It is a further object of the present invention to provide such a switch which does not require use of hazardous materials, such as mercury.

It is another object of the present invention to provide such a switch which employs printed circuit technology and may be provided as a very thin switch.

A further object of the present invention is to provide such a switch which will economically, structurally and functionally be suitable for a wide range of uses.

It is yet another object of the present invention to provide such a switch which enables the use of reduced power consumption.

These and other objects of the invention will be more fully understood from the following detailed description of the invention on reference to the illustrations appended hereto.

DESCRIPTION OF THE PREFERRED EMBODIMENTS

Figure 1:
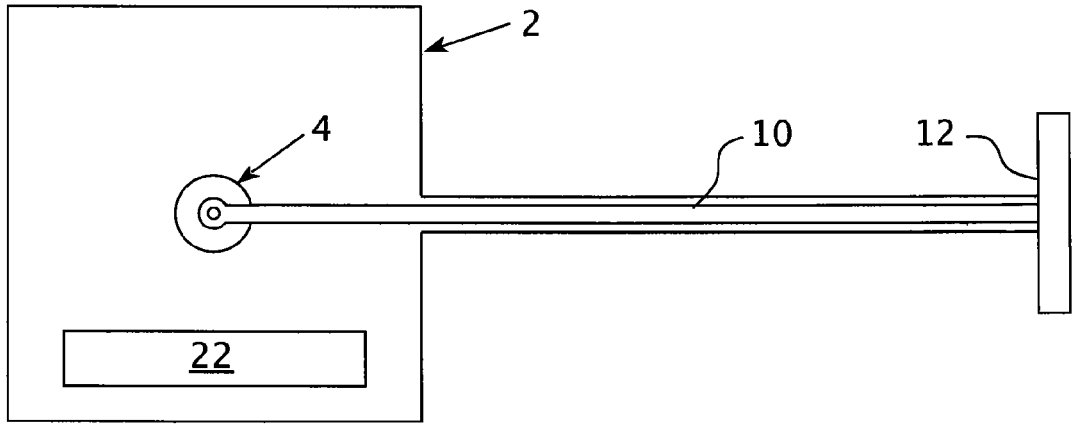
FIG. 1 is a front elevational view of a form of switch of the present invention provided on a suitable base member.
Figure 2:
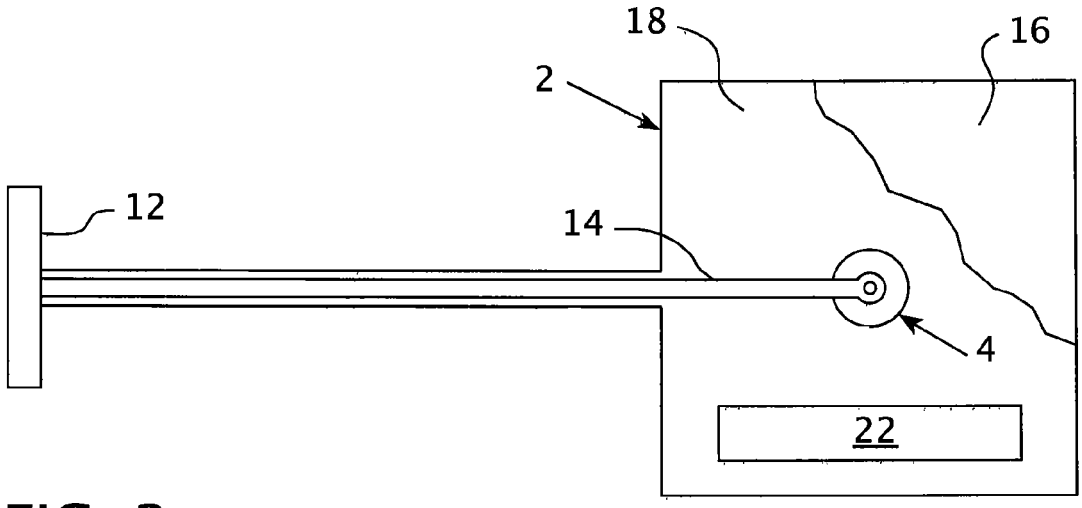
FIG. 2 is a rear elevational view of the switch and base of FIG. 1 with a portion of the adhesive layer and protective barrier broken away.

Referring now in greater detail to FIGS. 1 and 2, there is shown a base member 2 containing a switch 4 of the present invention secured to the base 2 and having a pair of electrically conductive strips 10, 14 extending outwardly therefrom to an object to be energized 12, which object might, for example, be a light-emitting diode (LED) or piezo electric device or other similar device such that when motion causes the switch to go on or off, responsive visual, audible or other events will occur. In the form shown, the rear surface of the base 2 has a strippable protective film 16 which is shown partially broken away underlying which is a layer of a pressure-sensitive adhesive 18 so as to facilitate securing the switch-supporting base 2 to another article. An alternate means of securing the switch base to a desired article would be facilitated through opening 22 defined within base 2. This would permit employing a lanyard, mechanical fastener or other mechanical element to secure the base to a person or object. The switch could also incorporate a stitchable material that would allow it to be sewn onto another item. The opening 22 could also function as a window to facilitate passage of light from LED's therethrough.

Figure 3:
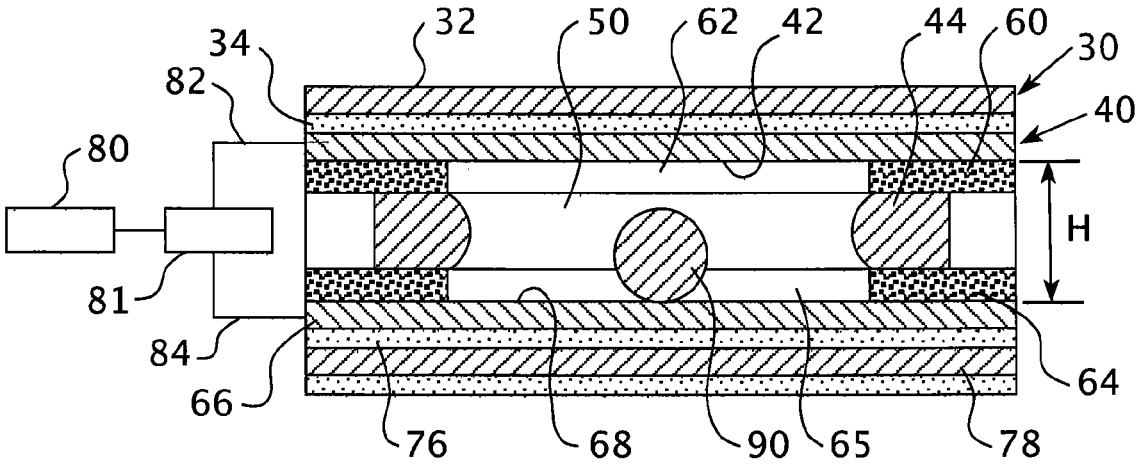
FIG. 3 is an elevational cross-sectional illustration of a switch assembly of the present invention showing an embodiment with an external source of power.

Referring to FIG. 3, there is an enlarged partially schematic cross-sectional illustration of one embodiment of a switch of the present invention. A switch 30 in the form shown has an outer layer 32 which may contain any desired graphic material and is secured by an interposed adhesive layer 34 to a first support 40 which has electrically conductive portions defining a circuit applied thereto (not shown in this view) such as screen printed conductive traces or copper circuits. The electrically conductive portions would be secured to the first support 40 on the lower surface 42. Underlying the first support 40 is an electrical conductor 44 which preferably will be a closed continuous conductor such as having a circular, oval or other closed geometric shape and defining a recess 50.

Figure 4:
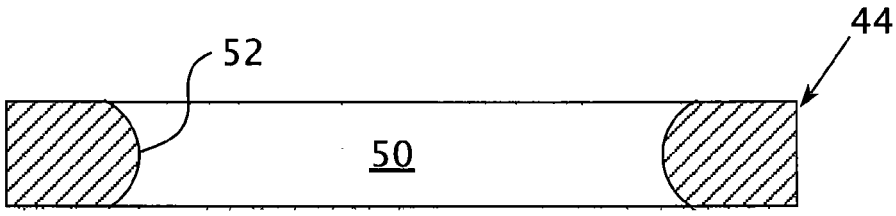
FIG. 4 is a cross-sectional illustration of an electrically conductive ring of an embodiment of the present.

As shown in FIG. 4, the inner surface 52 of the electrical conductor 44 preferably has a convexly configured recess-defining inner surface. This shape facilitates free movement of the electrically conductive movable element 90 within recess 50. An upper annular spacer 60 defines a recess 62 and a lower annular spacer 64 defines a recess 65. Underlying the lower spacer 64 is a second support member 66 which has on its upper surface 68 electrically conductive circuit components which may be provided as a printed circuit, if desired. Annular spacers 60, 64 are electrically insulative and insulate electrical conductor 44 from the electrical circuits on supports 40, 66. Spacers may be made from, for example, a resinous plastic foam. Underlying the second support 66 is an adhesive layer 76 which secures second support 66 to an underlying layer 78 which has a lower surface on which a pressure-sensitive adhesive has been applied. An internal or external power source 80, which provides electrical energy at a desired level and may be a battery, is connected to the upper electrical circuit by lead 82 and is connected to the lower electrical surface by lead 84. If desired, a timer 81 may be provided to control the period of operation of the switch 30. Items such as photo diodes could be incorporated as required to affect the functionality of the switch.

A movable electrically conductive element 90 in a preferred form will be of generally spherical shape, but other shapes permitting free movement may be employed. When the element 90 is in contact with both the electrical conductor 44 and, in the form shown, the electrical circuit on second support 66, this will complete the circuit, thereby permitting energy to flow therethrough to the two conductors 10 and 12 (not shown in this view) to the lamp or other element 12 (FIGS. 1 and 2). It will be appreciated that movement of the switch 30 will result in the electrically conductive movable element 90 engaging both the electrical conductor 44 and the circuit on second support 66 or if the switch is inverted, will result in similar contact between the electrical circuit on upper support 60 and the electrically conductive portion 44. The convex shape serves to facilitate free movement of the electrically conductive movable element 90. It will be appreciated that when the electrically conductive movable element 90 is not in contact with the electrical conductor 44, the switch will be in the "off" position and no electricity will flow therethrough, even though the electrically conductive movable element 90 may be in contact with the electrical circuit on either the upper support 60 or the lower support 66. In this manner, it will be appreciated that movement of the switch will result in the illumination or activation of a light-emitting diode or a piezo electric device, if that is what is electrically attached to the switch, or other electrically energized article. For example, an individual wearing the device when the individual moves would be subjected to the switch opening and closing, thereby creating on and off cycles of the electrically energized device. Additional circuitry, such as resistors, capacitors, field effect transmitter (FET) or other components, may be added to define other responsive actions prompted by the opening and/or closing of the switch as defined herein.

Figure 5:
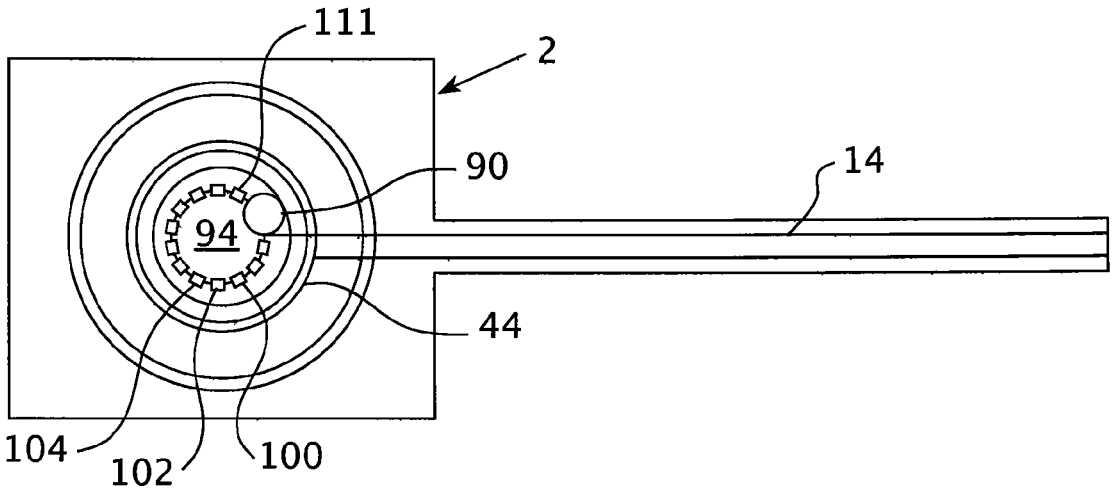
FIG. 5 is a cross-sectional illustration of a switch and base of the present invention showing the movable conductive element and a printed circuit.

Referring to FIG. 5, there is shown a cross-sectional view of the switch showing in plan the electrically conductive movable element 90, a circular electrical conductor 44, a support base 2 and a lower electrical conductor 14.

Figure 6:
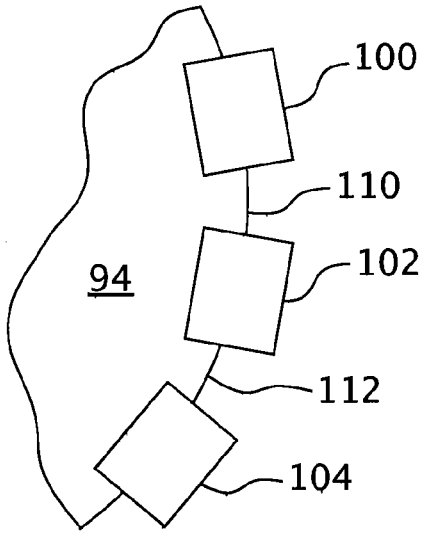
FIG. 6 is an enlarged fragmentary illustration of a portion of an electrical circuit employable in the present invention.

Referring in greater detail to the electrically conductive circuit elements as shown in FIGS. 5 and 6, the center portion 94 is electrically insulative and in the form shown is generally circular. A plurality of radially projecting, circumferentially spaced electrically conductive elements, such as 100, 102, 104, 111 are such that when the electrically conductive movable element 90 engages one of them and the electrical conductor 44, the circuit will be complete and when the electrically conductive movable element engages interposed dielectric portions 110, 112, the switch will be in the "off position". The electrically conductive movable element 90 preferably has a diameter more than double the spacing between the inner diameter of electrical conductor 44 and the outer diameter of the radially projecting portions, such as 104–111 of the electrical circuit, for example. Conductors 10 and 14 may be continuous screen-printed conductive traces which form areas 100, 102, 104 and the like. Dielectric material may be deposited over the conductive traces 10 and 14 to create non-conductive areas alternating with conductive areas 100, 102, 104 and the like. This conductive/non-conductive pattern is designed to increase the frequency and probability of the circuit fluctuating between closed and open states.

It will be appreciated that the printed circuit shown in FIG. 5 may be duplicated on both first support 40 (FIG. 3) and second support 66. This redundancy permits the switch to function regardless of switch orientation. It will also be appreciated that other conductive patterns which provide the desired functionality may be employed in lieu of the pattern shown in FIG. 5.

Figure 7:
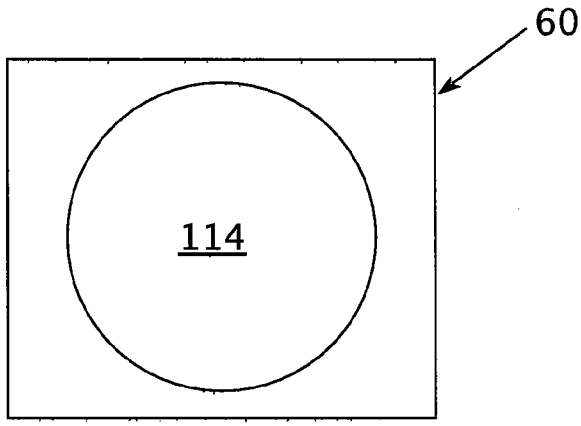
FIG. 7 is a plan view of a spacer layer employable with the present invention.

Referring to FIG. 7, there is shown a spacer element, such as 60 or 64, which has a central recess 114 for receipt of the switch.

Figure 8:
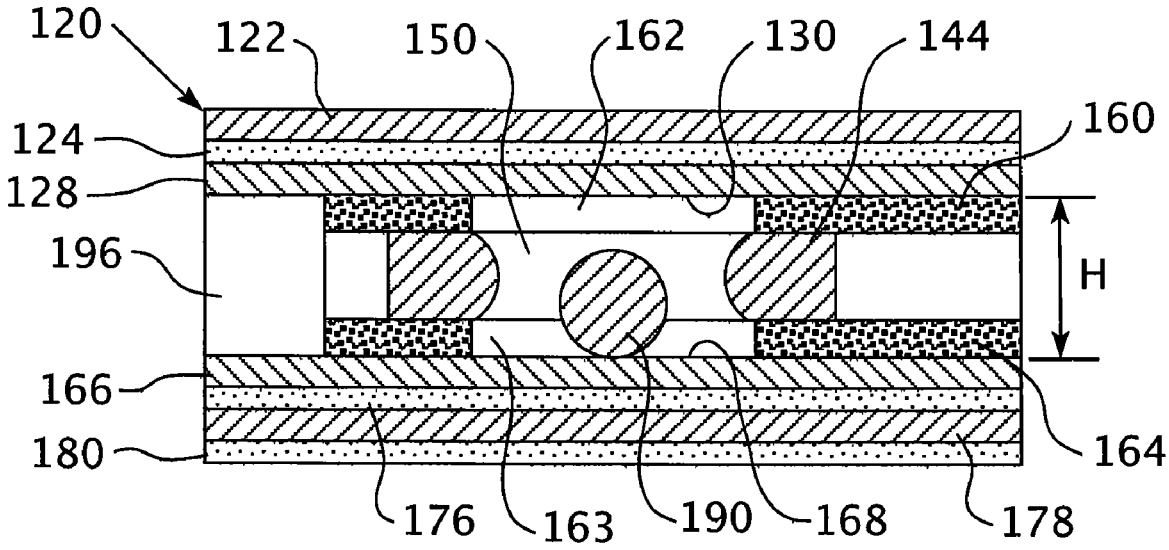
FIG. 8 shows a modified embodiment of the invention having an internal source of power.

Referring to FIG. 8, another embodiment of the invention will be considered. Shown in FIG. 8 is the switch assembly without the supporting base and emerging electrical conductors. The switch 120 in this embodiment has an upper graphic layer 122 secured by adhesive layer 124 to upper support 128 which contains on its lower surface 130 a first electrical circuit which may be of the type shown in FIG. 5 or any other desired type which will function in the manner described herein. An annular electrical conductor 144 is supported by electrically insulative upper spacer member 160 and electrically insulative lower spacer member 164. A second electrical circuit is also present on the upper surface 168 of the lower support 166 which makes contact with the annular electrical conductor 144. An electrically conductive movable element 190 is positioned within recess 150 and recesses 162, 163 which exist, respectively, in both the top and bottom regions as created by spacers 160 and 164. When the electrically conductive movable element 190 contacts the electrical conductor 144 and one of the electrical circuits, the switch is in the "on" position and when the electrically conductive movable 190 is not in contact with the electrical conductor 144, the switch is in the open or "off" position. Underlying the lower support 166 is a lower protective layer 178 which is secured to the support 166 by an adhesive layer 176. If desired, a further pressure-sensitive adhesive layer 180 may be employed with an appropriate strippable shielding layer (not shown) positioned thereunder. In the alternative, the switch may be secured to another object by using an applied stitchable material or mechanical assembly provided by holes passing through the entire assembly of the perimeter of the switch outside of any and all conductive areas.

In this embodiment of the invention, a power source, which in the form shown is a battery 196, is positioned within the assembly and is in electrical contact with both the electrical circuits positioned respectively on upper support 128 and lower support 166. The battery may be a 3-volt Lithium Polyer or 3-volt lithium battery, for example. As an alternate power source, if desired, a solar collector may be employed to energize the system. In a preferred embodiment of the invention, the height H (FIGS. 3 and 8) between the lower surface 42 of the upper support 40 and the upper surface 68 of the lower support 66 will preferably be about 0.007 to 0.120 inch and the electrically conductive movable element will have a maximum dimension of about 0.062 to 0.097 inch. While the invention is not limited to specific dimensions, it does provide a movable switch which may be made in small size, while preserving functionality. The overall height of the switch base as shown in FIG. 1 may be about 1.00 to 3.00 inches and the width might be about 1.00 to 3.00 inches, for example.

The annular electrical conductor 44, 144 may be composed of any suitable material, such as copper, aluminum or a conductive carbon pill, for example. Also, the electrically conductive trace in the circuits may be composed of silver, copper with gold flash, tin silver flash, tin nickel flash, carbon or aluminum, for example. The annular electrical conductor 44, 144 may be of unitary construction or, if desired, could be an assembly of a plurality of annular electrically conductive vertically stacked washer-like elements secured together by an electrically conductive adhesive, such as electrically conductive epoxy, for example. Such an adhesive may also be employed to enhance securement and electrical conductivity between annular electrical conductor 44, 144 and the adjacent electrically conductive portions of surfaces 42, 68, 130, 168, respectively.

It will be appreciated that the present invention provides for a movable switch assembly which does require the use of mercury or other hazardous materials. It contemplates a movable electrically conductive element being in contact with one of two electrical circuits with the switch being placed in the "on" position when the movable element also contacts an electrical conductor such as a conductive ring. The invention also provides for movement of the switch to result in cyclic on and off changes in the switch resulting in on and off actuation of a source of illumination such as an LED or lamp, sound such as a buzzer or operation of another electrically energized device. The invention also provides for movement of the switch to result in the responsive stimulation of subsequent events that are desired to occur upon detection of movement. These subsequent events may be determined based on the nature and function of the specific devices.

The invention may be employed in a wide variety of uses where its small size, lower power consumption and low cost of manufacture would be beneficial. For example, it may be worn on clothing, employed in toys and used in safety devices. In addition to uses on clothing for safety or other purposes, it will be appreciated that the switch may be employed to illuminate LED's or other lamps or energize other alarm-type systems, the switch being secured to physical articles such as backpacks, briefcases, luggage, bicycles and other articles where for safety or other reasons, the small, thin, low-energy switch of the present invention could be advantageously employed.

Whereas particular embodiments of the invention have been described herein for purposes of illustration, it will be evident to those skilled in the art that numerous variations of the details may be made without departing from the invention as set forth in the appended claims.

The invention claimed is:

1. A motion-activated electrical switch comprising a pair of spaced electrical circuits disposed on supports, an electrical conductor interposed between and electrically insulated from said spaced electrical circuits, an electrically conductive movable element structured to assume a first position in contact with an electrically conductive portion of one of said electrical circuits, and a second position in contact with an electrically insulated portion of said one of said electrical circuits, and a power supply for energizing said switch, whereby movement of said switch will effect electrical continuity between said electrically conductive movable element, said electrical conductor and said one of said electrical circuits when said electrically conductive movable element is in said first position and will effect a discontinuous circuit when said electrically conducted movable element is in said second position.

2. The motion-activated electrical switch of claim 1 including said electrical circuits being printed circuits.

3. The motion-activated electrical switch of claim 1 including said spaced electrical circuits being structured to permit the switch to function regardless of switch orientation.

4. The motion-activated electrical switch of claim 1 including said electrical conductor being a closed member defining an opening therethrough.

5. The motion-activated electrical switch of claim 4 including said electrical conductor being generally ring-shaped.

6. The motion-activated electrical switch of claim 5 including said ring having an opening-defining surface which is generally radially inwardly convex.

7. The motion-activated electrical switch of claim 1 including a first pair of elongated, electrically conductive strips, and one of said electrically conducted strips being secured to a first of said electrical circuits, and a second of said strips secured to said electrical conductor.

8. The motion-activated electrical switch of claim 7 including a second pair of electrically conductive strips having a third of said electrical strips secured to the other of said electrical circuits, and a fourth of said electrically conducted strips secured to said electrical conductor.

9. The motion-activated electrical switch of claim 1 including said electrical circuits and said conductor being secured within a housing to establish a unitary switch structure.

10. The motion-activated electrical switch of claim 9 including a switch-supporting base, and said unitary switch structure being fixedly secured to said base.

11. The motion-activated electrical switch of claim 10 including a pressure-sensitive adhesive secured to said base for attaching said base to an object or structure.

12. The motion-activated electrical switch of claim 1 including a power source operatively associated with said electrical switch.

13. The motion-activated electrical switch of claim 12 including said power source being a battery.

14. The motion-activated electrical switch of claim 13 including said battery being secured to said switch.

15. The motion-activated electrical switch of claim 1 including said electrical circuit supports being secured to electrically insulative spacers disposed on opposite sides of said electrical conductor.

16. The motion-activated electrical switch of claim 15 including said supports being secured to said spacers by an adhesive.

17. The motion-activated electrical switch of claim 1 including said electrical conductor being of unitary construction.

18. The motion-activated electrical switch of claim 1 including a first electrically conductive strip secured to a first of said circuits, and a second electrically conductive strip secured to said electrical conductor, whereby electrically connecting said first circuit with said electrical conductor will complete an electrical circuit.

19. The motion-activated electrical switch of claim 18 including a third electrically conductive strip secured to a second of said electrical circuits, and a fourth electrically conductive strip electrically connected to said electrical conductor, whereby electrically connecting said first circuit with said electrical conductor will complete an electrical circuit.

20. The motion-activated electrical switch of claim 19 including a base having a pressure-sensitive adhesive secured to one side thereof for securing said base to an object or structure.

21. The motion-activated electrical switch of claim 19 including a base having an opening therein for securing said base to an object or structure.

22. The motion-activated electrical switch of claim 1 including said electrical circuits having portions with an electrically conductive printed circuit and portions which are electrically insulative, and said switch being so structured as to effect contact between said electrically conductive movable element, said electrical conductor and either of said spaced electrical circuits in order to complete said electrical circuit.

23. The motion-activated electrical switch of claim 22 including said electrically conductive portions having a plurality of generally radially projecting portions disposed within said electrical circuits and said electrically insulative portions being interposed between adjacent ones of said electrically conductive portions.

24. The motion-activated electrical switch of claim 23 including said electrically conductive portions being made of a printed circuit composed of a material selected from the group consisting of silver, copper with gold flash, tin silver flash, tin nickel flash and aluminum.

25. The motion-activated electrical switch of claim 1 including said electrically conductive movable element being of generally spherical configuration.

26. The motion-activated electrical switch of claim 25 including said electrically conductive movable element having a diameter less than the spacing between a first of said electrical circuits and a second said electrical circuit.

27. The motion-activated electrical switch of claim 1 including a timer operatively associated with said switch for controlling a period of operation of said switch.

28. The motion-activated electrical switch of claim 23 including said electrically conductive movable element being of generally spherical configuration and having a diameter more than double the spacing between the inner diameter of said electrical conductor and the outer diameter of the radially projecting portions of said electrical circuits.

29. The motion-activated electrical switch of claim 1 including said electrical conductor being an assembly of annular electrically conductive portions secured to each other by an electrically conductive adhesive.

* * * * *